US006343696B1

(12) United States Patent
McCormick et al.

(10) Patent No.: US 6,343,696 B1
(45) Date of Patent: Feb. 5, 2002

(54) PROTECTIVE CONTAINER

(76) Inventors: Richard Lee McCormick; Linda Dianne McCormick, both of P.O. Box 730, Levelland, TX (US) 79336

( * ) Notice: Subject to any disclaimer, the term of this patent is extended or adjusted under 35 U.S.C. 154(b) by 0 days.

(21) Appl. No.: 09/286,811

(22) Filed: Apr. 6, 1999

(51) Int. Cl.[7] ..... B65D 81/02
(52) U.S. Cl. ..... 206/594; 206/521; 229/5.81
(58) Field of Search ..... 206/521, 591–594, 206/524.3–524.5, 524.9, 484, 484.2; 229/5.81, 122.32, 939

(56) References Cited

U.S. PATENT DOCUMENTS 2,807,402 A * 9/1957 Nelback ..... 206/594
4,629,651 A * 12/1986 Davis ..... 206/524.3
4,953,705 A * 9/1990 Evamy ..... 206/594
5,072,623 A * 12/1991 Hendershot ..... 220/560.03
5,285,957 A * 2/1994 Halsell ..... 229/939
6,056,438 A * 5/2000 Bradley ..... 383/117

* cited by examiner

*Primary Examiner*—Luan K. Bui
(74) *Attorney, Agent, or Firm*—The Matthew Firm; William P. Ramey, II

(57) ABSTRACT

An improved device and method for packaging, transportation, or handling in storage of products and materials, and especially materials such as painted or powder coated products and powder materials. The invention is understood to relate to a container in the form of a cardboard box having a liner of geotextile fabric. Optionally, the box has an inner box sandwiching the liner between itself and the outer box.

2 Claims, 3 Drawing Sheets

PROTECTIVE CONTAINER

TECHNICAL FIELD

The present invention relates to devices and methods for packaging and more particularly to improvements to devices and methods for transportation or handling in storage of products and materials, and especially materials such as painted or powder coated products and powder materials, and for other structures and methods as may be disclosed.

BACKGROUND ART

In the prior art, traditional containers used for packaging, transportation, and storage are corrugated cardboard packing containers. Corrugated cardboard comes in all shapes and sizes. Variations in the structure of the wave-shaped cardboard material ("flute") make up a board's corrugation. The number of flutes per foot and the thickness of the cardboard determine the stacking strength, crush resistance, puncture resistance, and weight of the container. Thus, to obtain added container strength, it traditionally requires using thicker corrugated cardboard, or using double or triple wall corrugation. This not only adds weight to the container which results in increased freight and shipping charges, but also results in more space being taken up during transportation and storage.

In the prior art, corrugated cardboard containers are filled with packing material in order to protect the container's contents. Traditionally, these packing materials have included such materials as sisal hemp, sponge rubber, rubber coated hair, creped kraft paper, newspaper, foam, and bubble wrap. Prior art references related to packaging materials include: U.S. Pat. No. 1,622,137 to Egbert, describes a cushioned packing case employing heavy felt fabric selected at least in part for its ability to avoid marring painted finishes; U.S. Pat. No. 2,408,246 to Walter, describes a cargo container having bumper pads formed from sisal hemp or sponge rubber; U.S. Pat. No. 2,897,959 to Perry et al., describes a cushioned box employing rubber coated hair which features construction essentially providing an inner box; U.S. Pat. No. 2,929,425 to Slaughter, suggests felted cotton and creped kraft paper as cushioning material for a shipping pouch; U.S. Pat. No. 2,962,158 to Struthers, proposes artificial fibrous cushioning material suitable for shipping containers. This material may employ acrylic, nylon, rayon, cellulose acetate, polyvinylidene chloride, and polyvinyl chloride as constituent materials. The material is soft enough to avoid abrading polished finishes, and U.S. Pat. No. 3,070,281 to Durkin et al., describes the use of polyurethane foam in fabricating a paper core tube for winding delicate webs of material. Although suitable for many products, these materials tend to scratch or mar powder coated products such as furniture, automotive parts, appliances, wooden products, decorative metals, bicycles, exercise equipment, or are too expensive to use, or are now unsuitable as packing material, for example, because the weight of felt fabric is too prohibitive.

Prior art references related to packaging systems that have eliminated packing material include U.S. Pat. No. 5,836,450 to Gonzales, describes improvements in packaging, more particularly to a packaging system wherein goods are secured into a container without contacting the exterior side of the container thereby helping to prevent damage to the goods if the container is dropped. It should be noted that these prior art packing materials and packing systems that have eliminated packing material provide no or limited protection to the contents of the container from punctures, provide no or limited additional support to the container itself, and provide little protection for large, heavy goods.

In the prior art from unrelated fields, geotextile material is a material that passes water but stops solid particles. Over the past decade a plethora of geosynthetic materials have become available for employment as seepage membranes, pavement crack stoppers, tank liners and soil reinforcement applications. Prior art references include: U.S. Pat. No. 5,472,297 to Heselden, utilizes geotextile fabric to line a cage; U.S. Pat. No. 5,558,245 to White, describes use of geotextile fabric as a padding material disposed between a metal tank and a flexible liner occupying the tank; and U.S. Pat. No. 5,505,557 to Bradley, describes the use of geotextile fabrics to fabricate bags and containers. Thus, geotextile containers have been adapted to serve as receptacles for soil, aggregate or other fill material, and for use in landslide mitigation technology using subdrainage. In addition, elongated geotextile containers are often utilized in a body of water, such as a bay or a river, to facilitate control of erosion.

Geotextile material has not been utilized as packing material for the transportation, handling, or storage of goods, although it has superior protective qualities having a very high rating against burst strength and impact testing, and in addition is resilient, light weight and inexpensive. Furthermore, many types of suitable geotextile are available from several manufacturers. Geotextile comes in various thicknesses and thus can both cushion and insulate. Geotextile material can be obtained, for example, but not for limitations from Amoco Fabrics and Fibers Company, one exemplary geotextile.

It would be a benefit, therefore, to have a packaging container that is strong and resistant to breakage and puncturing. It would be a further benefit to have a packaging container that is lightweight and thus reduce the cost of freight and shipping. It would be a further benefit to have a packaging container that is nonabrasive to the container's contents. It would be a still further benefit to have a packaging container that reduces the use of natural products. It would be still a further benefit to reduce the financial and environmental costs of filler. It would be a still further benefit to eliminate the cost and the need for disposal of the material normally used as filler. It would be a still further benefit to have a packaging container that can be reused.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Figure 1:
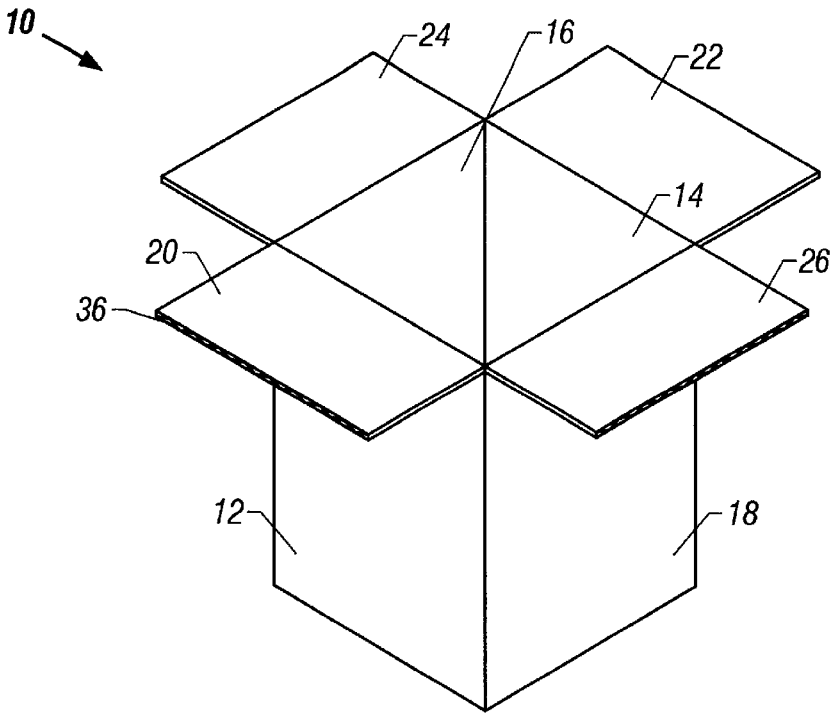
FIG. 1 is a perspective view of a preferred embodiment constructed according to the present invention.

While the invention herein is illustrated in connection with the preferred method and apparatus, it is to be understood that this illustration is not intended to limit the invention to that embodiment and procedure and includes all alternative modifications and equivalents as may be included within the spirit and scope of the invention as defined by the appended claims.

DESCRIPTION OF THE INVENTION

The invention in its most general aspect is an improved container for protecting an object from damage due to rough handling of the package, comprising a container body with at least one side wall extending upwardly from a closable bottom to an open top defining an inner cavity to permit the contents to be contained therein, a top closure, and a liner of geotextile material affixed to the body wall, closed bottom, and top closure, that strengthens the container, cushions the contents, and is nonabrasive to the contents.

The container body in a preferred embodiment is made of single wall corrugated cardboard. In another embodiment the container body is made of double or triple wall corrugated cardboard, or wood, or metal, or synthetic material such as plastic.

In a presently preferred embodiment, the container is a geotextile lined box made of single wall corrugated cardboard. The box includes four side walls with end closure flaps hingedly connected to the lower ends of the side walls to form the closable bottom and end closure flaps hingedly connected to the upper ends of the side walls to form the top closure. A liner of geotextile material is affixed to all the side walls and closure flaps with a general spray adhesive. Varying thickness of geotextile material may be affixed depending on how much cushion needs to be provided to protect the contents as well as how much strength is needed to strengthen and support the box. Thickness can be varied by selecting a particular geotextile, or by layering thinner geotextiles.

In other exemplary constructions, the container is a geotextile lined barrel. The barrel includes a cylindrical side wall and a closed or closable bottom defining an inner cavity, and a top closure. The closed or closable bottom and top closure having substantially the same diameter. A liner of geotextile material is affixed to the side wall, closed or closable bottom, and top closure.

In alternate embodiments, the container is a box in which the geotextile material is sandwiched and secured between an outer layer box and an inner layer box. The container may comprise a plurality of inner boxes secured to outer boxes. The double layer box again includes four side walls with end closure flaps hingedly connected to the lower ends of the side walls to form the closed bottom and end closure flaps hingedly connected to the upper ends of the side walls to form the top closure. A liner of geotextile material may be absence or partially affixed to the side walls, closed or closable bottom and top closure of the inner box.

Other alternate embodiments, the container is a barrel in which the geotextile material is sandwiched and secured between an outer barrel and an inner barrel. The container may comprise a plurality of inner barrels secured to outer barrels. A liner of geotextile material may be affixed to the side wall, closed or closable bottom and top closure of the inner barrel. The double layer barrel again includes a cylindrical side wall and a closed or closable bottom defining an inner cavity, and a top closure. The closed bottom and top closure have substantially the same diameter.

FIG. 1 is a perspective view of the protective container of the present invention generally designated by the numeral 10. The device 10 includes side walls 12, 14, 16, and 18. A first pair of innermost end closure flaps 20 and 22 is hingedly connected to the upper ends of opposing side walls 12 and 14. Innermost end closure flaps 20 and 22 each being no greater than the cross-sectional distance between opposing side walls 12 and 14 when the box is fully erected. A first pair of outermost end closure flaps 24 and 26 is hingedly connected to the upper ends of opposing side walls 16 and 18. Outermost end closure flaps 24 and 26 each being no greater than the cross-sectional distance between side walls 16 and 18 when the box is fully erected. End closure flaps 20, 22, 24, and 26 form the top closure when the box is fully erected.

A second pair of innermost end closure flaps is hingedly connected to the lower ends of side walls 12 and 14. Innermost end closure flaps each being no greater than the cross-sectional distance between side walls 12 and 14 when the box is fully erected. A second pair of outermost end closure flaps is hingedly connected to the lower ends of side walls 16 and 18. Outermost end closure flaps each being no greater than the cross-sectional distance between side walls 16 and 18 when the box is fully erected. End closure flaps form the closed bottom when the box is fully erected.

A liner of geotextile material 36 is secured to all side walls and end closure flaps. One means of securing the geotextile material is with a general spray adhesive. The preferred adhesive being a general spray adhesive manufactured by 3M. Other means of securing the geotextile material include but are not limited to staples, tacks, rivets, velcro, and other glues. The geotextile material need not be affixed to all side walls and end closure flaps.

Figure 2:
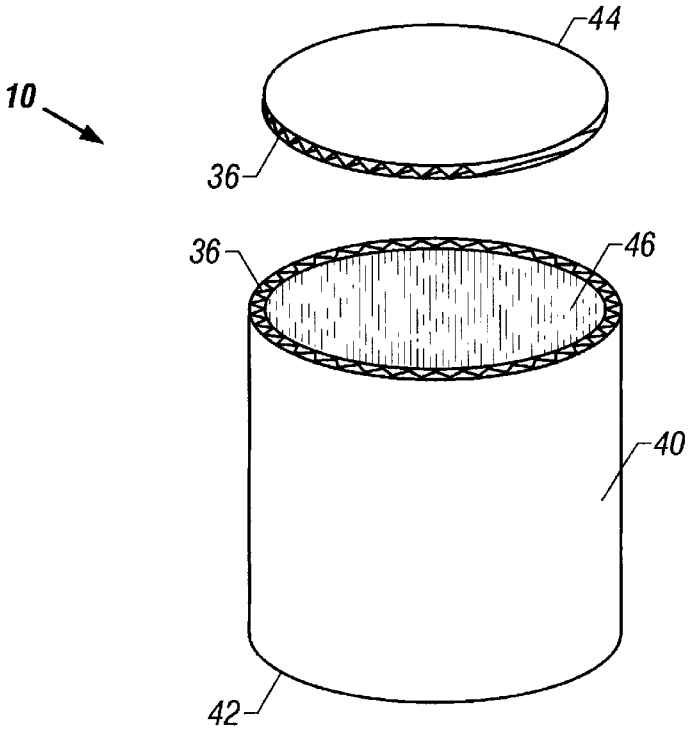
FIG. 2 is a perspective view of another preferred embodiment of the present invention.

FIG. 2 is a perspective view of another protective container of the present invention generally designated by the numeral 10. The device 10 includes a side wall 40, a closed or closable bottom 42 defining an inner cavity 46 to permit the contents to be contained, and a single top closure 44. The closed or closable bottom 42 and top closure 44 having substantially the same diameter. A liner geotextile material 36 is adhesively secured with a general spray adhesive to the side wall 40, closed bottom 42, and top closure 44.

Figure 3:
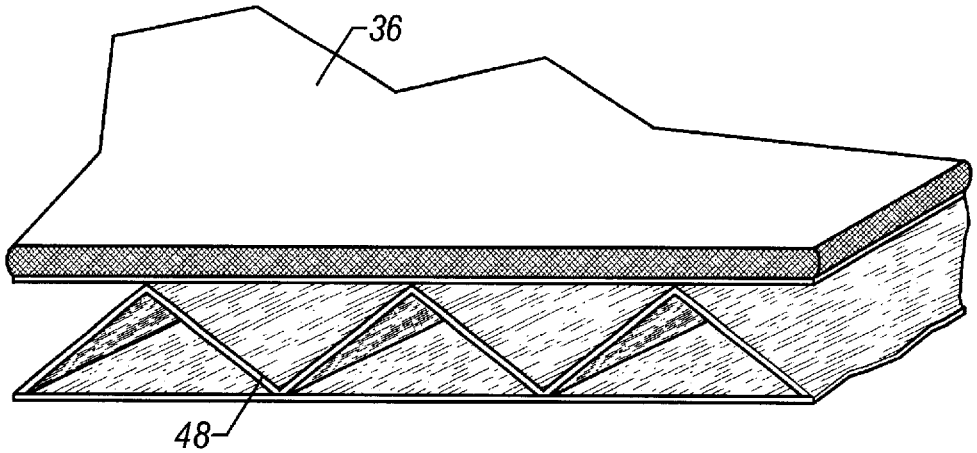
FIG. 3 is a cross-sectional view of a preferred embodiment of the present invention shown in FIG. 1.

As illustrated in FIG. 3, a liner of geotextile material 36 is adhesively secured to single wall corrugated cardboard 48. FIG. 3 shows a cross-sectional view of a single layer of geotextile material 36 adhesively secured with a general spray adhesive to single wall corrugated cardboard 48.

Figure 4:
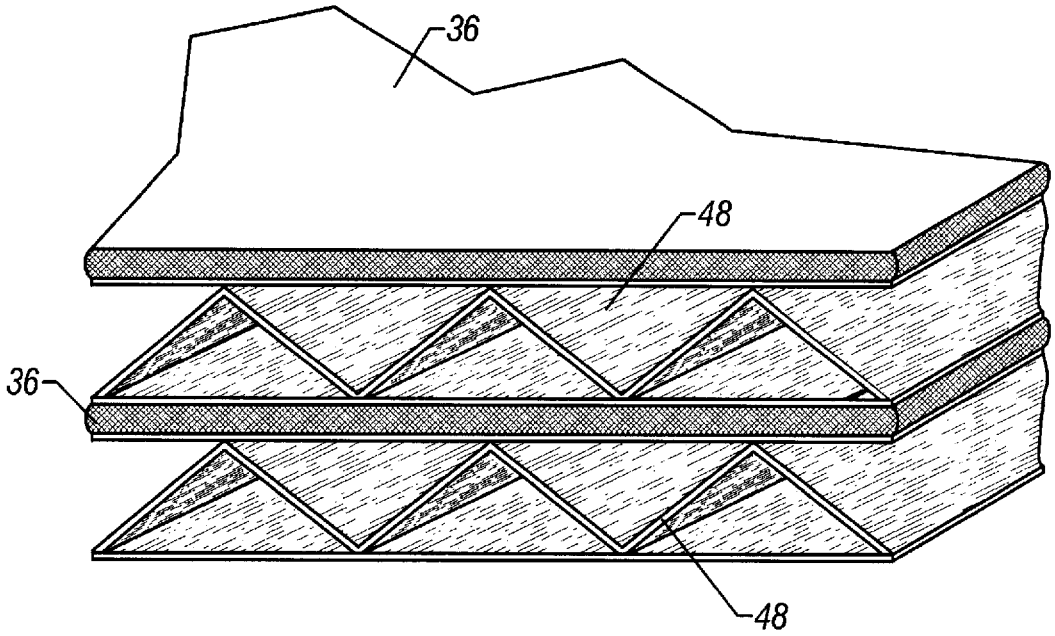
FIG. 4 is a cross-sectional view of another preferred embodiment of the present invention shown in FIG. 1.

FIG. 4 shows a cross-sectional view of two layers of geotextile material 36 adhesively secured with a general spray adhesive to and sandwiched between two layers of single wall corrugated cardboard 48. In FIG. 4 a single layer of geotextile material 36 is affixed to single wall corrugated cardboard 48 that is affixed to another single layer of geotextile material 36 affixed to another single wall corrugated cardboard 48.

Figure 5:
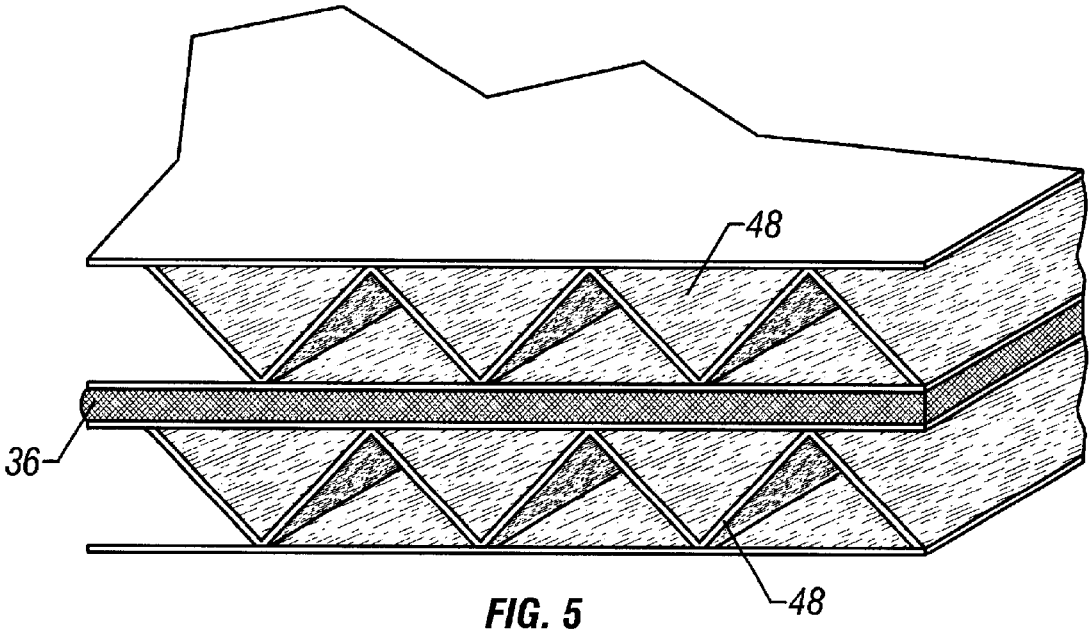
FIG. 5 is a cross-sectional view of still another preferred embodiment of the present invention shown in FIG. 1.

FIG. 5 shows a cross-sectional view of a single layer of geotextile material 36 adhesively secured with a general spray adhesive between an inner and outer layer of corrugated cardboard 48.

It can be seen from the preceding description that methods and devices for packaging and more particularly to improved devices and methods for transportation or handling in storage of products and materials has been provided.

From the foregoing it will be seen that this invention is one well adapted to attain all of the ends and objects hereinabove set forth, together with other advantages which are obvious and which are inherent to the apparatus.

It is noted that the embodiment of the geotextile container described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A container for holding and protecting an object from damage, the container comprising:

a container body with at least one side wall with an upper portion and a lower portion extending upwardly from a closable bottom to a closable top, defining an inner cavity to permit contents to be contained therein;

a liner of geotextile material in the container body affixed to said at least one side wall, the closable bottom, and the closable top, for protecting the contents to be contained; and, said container body is a box further comprising an inner box affixed to said geotextile liner; and a liner of geotextile material in said inner box affixed to said geotextile liner.

2. The container as set forth in claim 1, further comprising:

a plurality of inner boxes.

* * * * *